US007134531B2

(12) United States Patent
Ramey et al.

(10) Patent No.: US 7,134,531 B2
(45) Date of Patent: Nov. 14, 2006

(54) HEAVY LOAD CARRY SLIPS AND METHOD

(75) Inventors: Joe Stewart Ramey, Youngsville, LA (US); Wilson Andrew Leblanc, Jr., New Iberia, LA (US)

(73) Assignee: Access Oil Tools, Inc., Broussard, LA (US)

( * ) Notice: Subject to any disclaimer, the term of this patent is extended or adjusted under 35 U.S.C. 154(b) by 0 days.

(21) Appl. No.: 10/810,228

(22) Filed: Mar. 26, 2004

(65) Prior Publication Data

US 2004/0182611 A1 Sep. 23, 2004

Related U.S. Application Data

(63) Continuation-in-part of application No. 10/198,542, filed on Jul. 16, 2002, now abandoned.

(51) Int. Cl.
*B65H 59/10* (2006.01)

(52) U.S. Cl. ..... 188/67; 175/423

(58) Field of Classification Search ..... 188/67; 175/423

See application file for complete search history.

(56) References Cited

U.S. PATENT DOCUMENTS

| | | | | |
|---|---|---|---|---|
| 1,623,885 | A | 5/1927 | Montgomery | |
| 1,758,108 | A | 5/1930 | Goeser | |
| 1,820,479 | A | 8/1931 | O'Brien | |
| 1,834,316 | A | 12/1931 | McLagan | |
| 2,030,499 | A | 2/1936 | Church | |
| 2,071,637 | A * | 2/1937 | Laurent | 188/67 |
| 2,119,731 | A | 6/1938 | Abegg | |
| 2,143,615 | A | 1/1939 | Abegg | |
| 2,245,979 | A | 6/1941 | Johnson | |
| 2,282,758 | A | 5/1942 | Gallagher | |
| 2,287,432 | A | 6/1942 | Kinzbach | |
| 2,290,799 | A | 7/1942 | Brauer | |
| 2,520,448 | A | 8/1950 | Abegg | |
| 2,552,618 | A | 5/1951 | Boatright | |
| 2,607,098 | A | 8/1952 | Wilson | |
| 2,814,087 | A | 11/1957 | Palmer | |
| 2,962,919 | A | 12/1960 | Grundmann et al. | |
| 3,365,762 | A | 1/1968 | Spiri et al. | |
| 3,538,561 | A | 11/1970 | Anastasiu et al. | |
| 4,336,637 | A | 6/1982 | Patterson | |
| 4,355,443 | A | 10/1982 | Blackwell | |
| 4,381,584 | A | 5/1983 | Coyle, Sr. | |
| 4,511,168 | A | 4/1985 | Haynes | |
| 4,681,193 | A | 7/1987 | Crowe | |
| 4,715,625 | A | 12/1987 | Shows, Jr. et al. | |
| 4,823,919 | A | 4/1989 | Hayatdavoudi | |
| 5,335,756 | A | 8/1994 | Penisson | |
| 5,451,084 | A | 9/1995 | Jansch | |
| 5,484,040 | A | 1/1996 | Penisson | |
| 5,609,226 | A | 3/1997 | Penisson | |

(Continued)

*Primary Examiner*—Thomas Williams
(74) *Attorney, Agent, or Firm*—C. Dean Dominqué; Robert L. Waddell; Ted M. Anthony

(57) ABSTRACT

A tubular handling device. The device includes a plurality of slips, and wherein the slips have an arcuate inner face that has a longitudinally disposed slot and a ledge therein. The device further comprises an insert having a shoulder that is configured to fit within the ledge, and wherein the insert is capable of transferring a load from the shoulder to the ledge. In one preferred embodiment, the outer portion of the slips have a taper of greater than 11 degrees and a complementary bowl insert is provided that has a matching taper. A method of handling tubular members on a drilling rig is also disclosed.

19 Claims, 13 Drawing Sheets

U.S. PATENT DOCUMENTS 6,264,395 B1 7/2001 Allamon et al.
6,394,201 B1 * 5/2002 Feigel et al. ..... 175/423
6,845,814 B1 * 1/2005 Mason et al. ..... 175/423

* cited by examiner

HEAVY LOAD CARRY SLIPS AND METHOD

This application is a continuation in part of my presently pending patent application, bearing Ser. No. 10/198,542, filed on 16 Jul. 2002 now abandoned.

BACKGROUND OF THE INVENTION

This invention relates to a tubular handling device. More particularly, but not be way of limitation, this invention relates to a tubular slip device and method.

In the drilling for oil and gas, the tubular members utilized during drilling, completion and work over operations are required to be hung off at the drill floor. The device generally used is referred to as a rotary slip. The prior art devices include an apparatus capable of encircling the tubular member. The apparatus has on its inner face slip means for gripping onto the tubular member. The apparatus is placed into a slip bowl on the drill rig floor, as is very well understood by those of ordinary skill in the art. Conventional rotary slips are commercially available from Access Oil Tools, Inc. of New Iberia, La. under the name "DU" and "SDU" Style Rotary Slips.

In the normal operation of rotary slips, the weight of the pipe tends to wedge the three slip segments back latterly into the slip bowl. The teeth like projections of the inserts dig into the pipe then the slip wedges into the bowl to prevent the pipe from falling into the hole while making or breaking out connections on the rig floor. The bottom ledge of the slip segment, on which the bottom inserts sit, tends to carry a disproportionately large amount of the weight on the slip. Failure of a slip tends to manifest itself in bending or toeing outward of the bottom of the slip segments on this ledge, especially when the slips sit in a worn bowl since the slips are unsupported.

The slip device is inserted into a slip bowl on the drill floor. The slip device is constructed in a generally wedge shape and contains die inserts. The work string is disposed within the slip device and the slip device, and in particular, the die inserts will engage the work string. The inner section of the slip device will engage the work string which in turn cause the die inserts to the engage the work string.

The basic slip and bowl design is used for running drill pipe, casing, liners, bottom hole assemblies, etc. As the search for oil and gas continues, operators find it necessary to drill in more exotic environments, which includes ocean drilling. The water depths in ocean drilling may reach 10,000 feet and more in some instances. Thus, as operators run into the wells with casing, for instance, a landing string that is attached to the casing string. The landing string is necessary due to the 10,000 feet of riser in place which runs from the floating rig floor to the ocean floor. As will be appreciated, the combined landing string and casing applies a heavy load on the slip and bowl.

In combination with this deep water drilling, the actual wells that are drilled are increasingly deep in order to strike these commercially feasible hydrocarbon reservoirs. Hence, these wells can easily reach 25,000 feet in length. The equipment used with these deep water wells is large and extremely heavy. As understood by those of ordinary skill in the art, the lifting and lowering capacity of the drilling rigs is being severely tested.

For instance, if an operator is running a casing string into a well bore, the operatoeris required to lower that proper amount of casing. However, the operator will also be required to lower a landing string, and wherein the ultimate length of the landing string will be basically equal to the depth of the water. Therefore, the weight of the casing string and the landing string has pushed the operating capacity of the drilling rigs to its maximum.

The landing string is specifically designed to provide the very high tensile strengths to safely land out casing in the sub-sea well head. As the water depth increases, the length and weights of the landing string increase proportionateley. Existing mobile offshore drilling units (MODU's) are now operating at or near their maximum hoisting capabilities. Casing loads of 1,600,000 pounds have been experienced. This exposes the entire load hoisting system to maximum loading.

As the loads are increased, there is a danger of crushing the pipe, or alternatively, of slip failure. Conventional slips have a three inch (which translates to 7.12502 degrees) or four inch (which translates to 9.46232 degrees) taper per foot. This means for every twelve inches of vertical height at the top of the slip, the slip is three or four inches larger in diameter than the bottom. This is what helps to create the wedge effect in the bowl that suspends the pipe while connections or made to extend or shorten the drill string when going in or coming out of the hole. The prior art tapering worked well for a long time in the oilfield. However, with the use of landing strings in deepwater drilling and running long strings of casing down to the ocean floor on the bottom of a string of drill pipe, the crushing of the drill pipe, or alternatively, the slip failure has become an area of significant concern. In the case of failure, the damage to the well could be catastrophic and could lead to dire consequences for the rig crew.

Therefore, there is a need for a slip that will not crush the landing string. Also, there is a need for slips that will support heavy loads, including landing strings. Additionally, there is a need for slips that will grip these heavy tubulars, including landing strings.

There is also a need for a slip device that ensures that the total weight of the string is distributed more evenly over the full vertical height of all the slip segments. There is also a need for a rotary slip that can withstand significant loading forces without premature failure or fatigue. These needs, and many others, will be met by the invention herein disclosed.

SUMMARY OF THE INVENTION

A rotary slip apparatus for handling tubular members on a drill rig floor is disclosed. The rotary slip apparatus comprises a first slip having a first arcuate inner face and an outer face, wherein the inner face has a first longitudinally disposed slot that contains a first ledge therein. The apparatus also contains a second slip that is connected to the first slip, with the second slip having a second arcuate inner face and an outer face. The apparatus also contains a third slip having a third arcuate inner face and outer face.

The apparatus further comprises means for attaching the first slip with the second slip, and the second slip with the third slip so that the first, second, and third slip inner faces engage a first tubular member on the drill rig floor. A first insert is included, with the first insert having a first shoulder that is configured to fit within the first ledge, and wherein the first shoulder transfers a load from the first insert to the first ledge.

In one embodiment, the second slip's inner face has a second longitudinally disposed slot and wherein the second longitudinally disposed slot has a second ledge therein. The apparatus further comprises a second insert having a second shoulder that is configured to fit within the second ledge and wherein the second shoulder transfers the load from the second insert to the second ledge.

Additionally, the third slip's inner face has a third longitudinally disposed slot and wherein the third longitudinally disposed slot has a third ledge therein. The apparatus further comprises a third insert that contains a third shoulder that is configured to fit within the third ledge and wherein the third shoulder transfers a load from the third insert to the third ledge.

The tubular handling device may further comprise a fourth ledge disposed within the first longitudinally disposed slot. Also included will be a fourth insert having a fourth shoulder that is configured to fit within the fourth ledge and wherein the fourth shoulder transfers the load from the fourth insert to the fourth ledge.

The tubular handling device may also contain a fifth ledge disposed within the second longitudinally disposed slot, along with a fifth insert. The fifth insert will have a fifth shoulder that is configured to fit within the fifth ledge and wherein the fifth shoulder transfers a load from the fifth insert to the fifth ledge. A sixth ledge may also be included, with the sixth ledge being disposed within the third longitudinally disposed slot. The sixth insert has a sixth shoulder that is configured to fit within the sixth ledge and wherein the sixth shoulder transfers a load from the sixth insert to the sixth ledge.

In one embodiment, the inserts are constructed of a 8620 steel, 1018 steel, or a low carbon alloy steel material. Additionally, in a preferred embodiment, the first, second, third, fourth, fifth, and sixth ledge has a bottom surface having an angle of plus 20 degrees to a minus 20 degrees relative to a horizontal plane and wherein the shoulder on the inserts has a complimentary angle of plus 20 degrees to a minus 20 degrees.

A method of engaging a tubular member within a rotary table on a drill rig floor is also disclosed. The method includes providing a slip device, with the slip device comprising: a first slip with an inner face that has a first longitudinally disposed slot that has a first and second ledge; a second slip being connected to the first slip, with the second slip having an arcuate inner face that has a second longitudinally disposed slot that has a third and fourth ledge therein; a third slip that has a third longitudinally disposed slot with a fifth and sixth ledge therein; a first insert having a shoulder that is configured to fit within the first ledge; a second insert having a shoulder that is configured to fit within the second ledge; a third insert having a shoulder that is configured to fit within the third ledge; a fourth insert having a shoulder that is configured to fit within said fourth ledge; a fifth insert having a shoulder that is configured to fit within the fifth ledge; a sixth insert having a shoulder that is configured to fit within the sixth ledge.

The method further comprises placing a first tubular member within the rotary table on the drill rig floor and inserting the slip device into the rotary table. Next, the slip device is engaged about the first tubular member so that the first insert, the second insert, the third insert, the fourth insert, fifth insert and the sixth insert engage the first tubular member suspending the first tubular member from the rotary table. The method includes transferring the load of the first tubular member to the first insert, the second insert, the third insert, the fourth insert, the fifth insert, and the sixth insert, which in turn transfers the load to the first shoulder, the second shoulder, the third shoulder, the fourth shoulder, the fifth shoulder, and the sixth shoulder.

The method further includes transferring the load from the first, second, the third shoulder, the fourth shoulder, the fifth shoulder, and the sixth shoulder to the corresponding first, second, the third, fourth, fifth, and sixth ledge of the respective first, second and third slip. With this design, the load of the first tubular member is distributed about the length of the first slip, the second slip and the third slip.

The method also comprises threadedly connecting a second tubular member to the first tubular member, and then removing the slip device from the rotary table. The connected first tubular member and the second tubular member are lowered into the well bore and the slip device is inserted into the rotary table. The slip device is engaged about the second tubular member and the load of the first and the second tubular member is transferred to the first, the second, the third, the fourth, the fifth and the sixth insert which in turn transfers the load from the first, second, third, fourth, fifth, and sixth shoulder to the first, second, third, fourth, fifth, and sixth ledge of the respective first, second and third slip. Hence, the load of the first and the second tubular member is distributed about the length of the first slip, the second slip and the third slip.

In a second embodiment, which is the most preferred embodiment of this application, an apparatus for handling a work string disposed within a rotary table on a rig is disclosed. In this second preferred embodiment, the apparatus comprises a bowl insert having an inner portion, wherein the inner portion has a taper of greater than 11 degrees, and slip means for securing the work string within the rotary table. The slip means contain an outer portion configured to fit into the inner portion of the bowl insert, with the outer portion having a taper complementary of the bowl insert taper of greater than 11 degrees. In one preferred embodiment, the inner portion taper of the bowl insert is between 11 degrees and 15 degrees. In another preferred embodiment, the outer portion taper of the slip means is between 11 degrees and 14 degrees. In yet another preferred embodiment, the inner portion taper of the bowl insert is 12 degrees and the outer portion taper of the slip means is a complimentary angle of 12 degrees. In the most preferred embodiment, the slip means comprises a first, second and third slip means containing a plurality of dies for engaging the work string.

Additionally, in this second embodiment, a method of running a landing string into a well on a rig is disclosed. The method comprises providing a bowl insert having an inner portion, with the inner portion having a taper of greater than 11 degrees, and a slip device having dies for securing the work string within a rotary table on the rig, with the slip device having an outer portion configured to fit into the inner portion of the bowl insert, with the outer portion having a taper complementary of the bowl insert taper. The method further includes attaching the landing string to a bottom hole assembly and lowering a first tubular of the landing string into the rotary table located on the rig. Next, the slip device is placed into the rotary and the first tubular is lowered. The dies of the slip device are engaged with the first tubular and the weight of the landing string is transferred axially, and the weight is also transferred transversely (horizontally). The operator will suspend the landing string within the rotary table, disengage the dies from the first tubular, and remove the slip device from the rotary table.

The method may further comprise lowering a second tubular of the landing string into the rotary table located on the rig and placing the slip device into the rotary. Next, the second tubular is lowered and the dies of the slip device are engaged with the second tubular. The weight of the landing string is transferred axially, and the weight of the landing string is transferred transversely (horizontally). The landing string is suspended within the rotary table and the dies from the second tubular are disengaged. The slip device can then be removed from the rotary table.

In this second embodiment, the method may further include lowering a third tubular of the landing string into the rotary table located on the rig, and placing the slip device into the rotary. Next, the method includes lowering the third tubular and engaging the dies of the slip device with the third tubular. The weight of the landing string is transferred axially and transversely (horizontally). The landing string is suspended within the rotary table and the dies from the third tubular are disengaged. The slip device can then be removed from the rotary table. In one preferred embodiment, the inner portion taper of the bowl insert is between 11 degrees and 15. Also, in one preferred embodiment, the outer portion taper of the slip means is between 11 degrees and 14. In one preferred embodiment, the inner portion taper of the bowl insert is 12 degrees and the outer portion taper of the slip means is a complimentary angle of 12 degrees.

An advantage of the present invention is that the new slip design ensures that the total weight of the string is distributed more evenly over the full vertical height of all the slip segments. Another advantage is that each insert is supported individually in the insert slot. This ensures that the loading forces are distributed away from the bottom of the slip, which is the thinnest section, and hence more susceptible to failure.

Another advantage is that the novel slip design will allow for longer slip lives. Yet another feature is that more weight can be suspended from the slips. For instance, the present design can be utilized in deep water drilling applications, since significant loads are created by the tubular work string. Still yet another advantage is that the inserts can be visually inspected when not in use for wear and fatigue. Yet another advantage is that the inserts can be easily replaced on the drill site.

An advantage of the second embodiment, which is the most preferred embodiment of this application, is that this embodiment allows for supporting a vertical load without generating an excessive transverse load that will crush the tubular being gripped at the rotary table. The transverse force that produces the gripping effect of the slips to hold the pipe from falling into the well is also the same force that crushes the pipe. Hence, if the pipe starts to crush, then the slips will also start to fail because of the improper loading. When this starts to happen, there is a domino effect that takes place and both problems are accelerated. Hence, an advantage is that the present invention prevents the crushing of the pipe which in turn slows down the deterioration of the slips. Yet another advantage is that the invention is designed specifically for the job of lowering heavy loads of casing, and other tubulars to the ocean floor, on the bottom of conventional drill pipe or landing strings.

A feature of the present invention is the angle machined into the ledge is complementary to the shoulder angle on the insert. Another feature is the gap between the individual longitudinal inserts in the event that an insert deforms longitudinally downward during use, the deformed insert will not press up against the adjacent insert. Another feature is that while rotary slips are shown, the invention is applicable to other slips such as, but not limited to, drill collar slips, casing slips and conductor slips.

Also, a feature of the invention herein disclosed is that the outer slip can have an angle greater than 11 degrees. Another feature is that the inner bowl will have an angle complementary of the outer slip. Yet another advantage is that the angle of the taper on the slip and bowl can vary from 11 to 15 degrees.

DETAILED DESCRIPTION OF THE PREFERRED EMBODIMENTS

Figure 1:
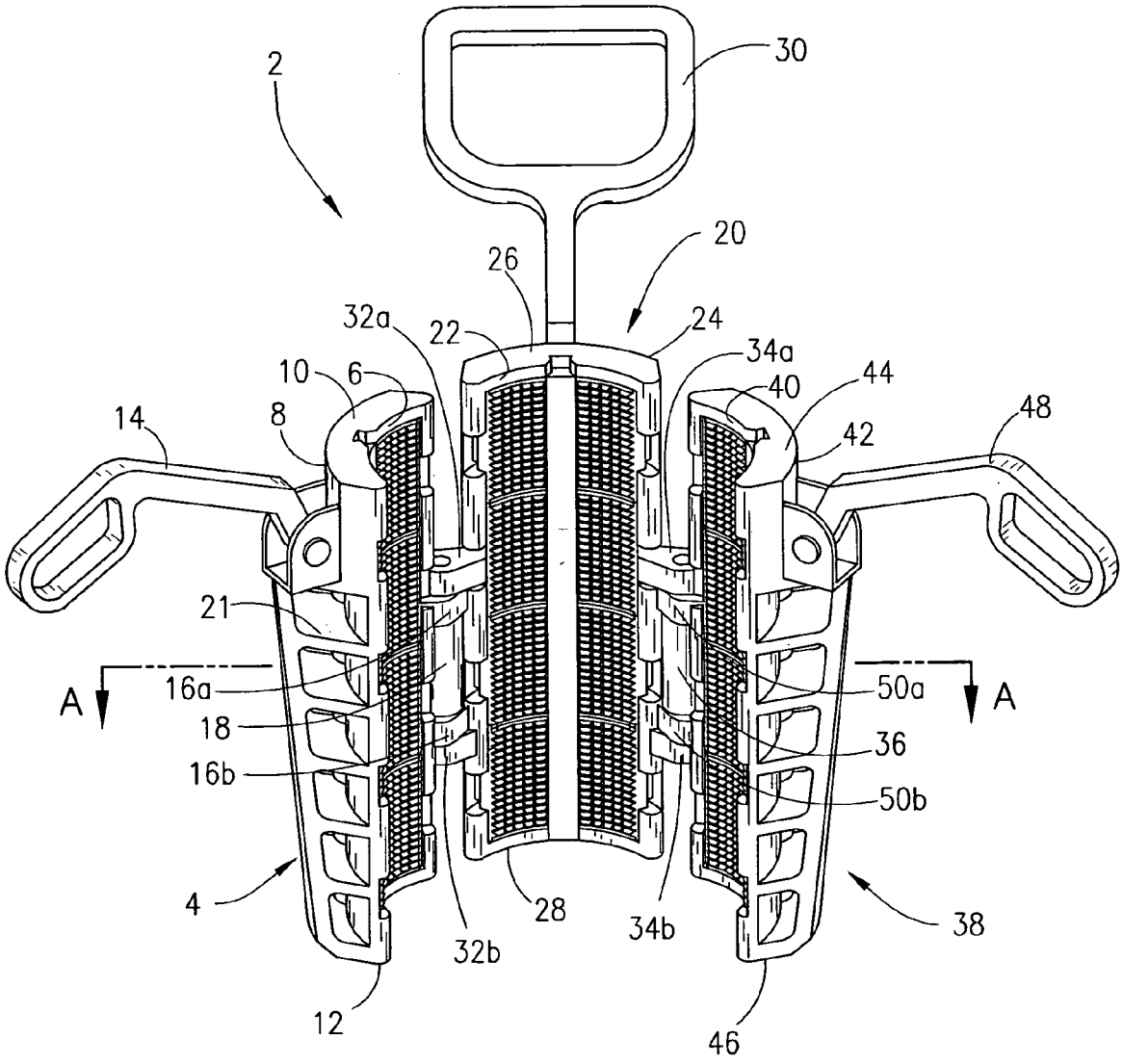
FIG. 1 is a perspective view of the preferred embodiment of the assembled rotary slips of the present invention.

Referring now to FIG. 1, which is a perspective view of the assembled rotary slips, the preferred embodiment of the present invention will now be described. The rotary slips 2 are also sometimes referred to as a tubular handling device 2. The rotary slips 2 include a first slip 4, with the first slip 4 having a generally arcuate inner face 6 and a generally arcuate outer face 8. The slip 4 has a top end 10 and a bottom end 12. As seen in FIG. 1, the slip's profile is generally in a wedge shaped contour with the outer face 8 being tapered to the bottom end 12.

Figure 10:
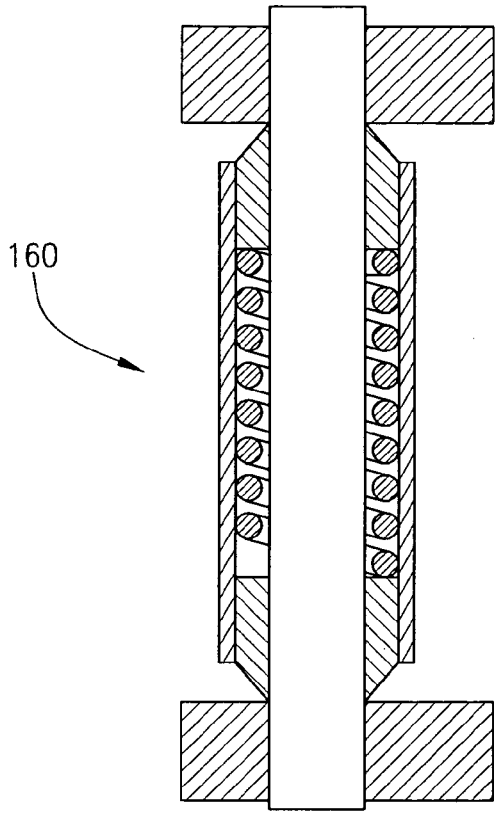
FIG. 10 is a partial cross-sectional view of the spring hinge assembly used with this invention.

The slip 4 contains a handle member 14, with the handle member 14 being connected to the slip 4 with conventional means such as pins and cotters. Attachment means for attaching the slip 4 with the slip 20 includes the slip 4 containing a pair of projections 16*a*, 16*b* that have openings therein for placement of a hinge spring assembly 18 (which is also seen in FIG. 10) for connection with the second slip 20. The outer face and inner face are connected by a series of ribs. The slips may be formed as a single wedge block; however, that tends to make the slips very heavy. By having the series of ribs (seen generally at 21), the rotary slips 2 generally are lighter, but retain the necessary strength and integrity for use in grasping and holding onto tubular members, as will be understood by those of ordinary skill in the art. The inner face 6 will have disposed therein the novel insert members that will be described in greater detail later in the application.

The second slip 20 also contains a generally arcuate inner face 22 and a generally arcuate outer face 24. The slip 20 has a top end 26 and a bottom end 28. As noted earlier, the slip's profile is generally in a wedge shaped contour with the outer face 24 being tapered to the bottom end 28.

The second slip 20 contains a handle member 30, with the handle member 30 also being connected to the slip 20 with conventional means such as pins and cotters. The slip 20 also includes a pair of projections 32*a*, 32*b* that have openings therein for placement of the hinge spring assembly 18 for connection with the first slip 4. The inner face 22 will have disposed therein the novel insert members that will be described in greater detail later in the application. The second slip 20 also contains second attachment means for attaching to the third slip 38 which includes a second pair of projections 34*a*, 34*b* that also have openings therein for placement of a hinge spring assembly 36 for connection with the third slip 38.

The third slip 38 also contains a generally arcuate inner face 40 and a generally arcuate outer face 42. The slip 38 has a top end 44 and a bottom end 46. The slip's profile is also a wedge shaped contour with the outer face 42 being tapered to the bottom end 46.

The third slip 38 contains a handle member 48, with the handle member 48 also being connected to the third slip 38 with conventional means such as pins and cotters, as stated earlier. The slip 38 also contains a pair of projections 50*a*, 50*b* that have openings therein for placement of the hinge spring assembly 36 for attachment with the second slip 20. The inner face 40 will have disposed therein the novel insert members that will be described in greater detail later in the application.

Figure 2:
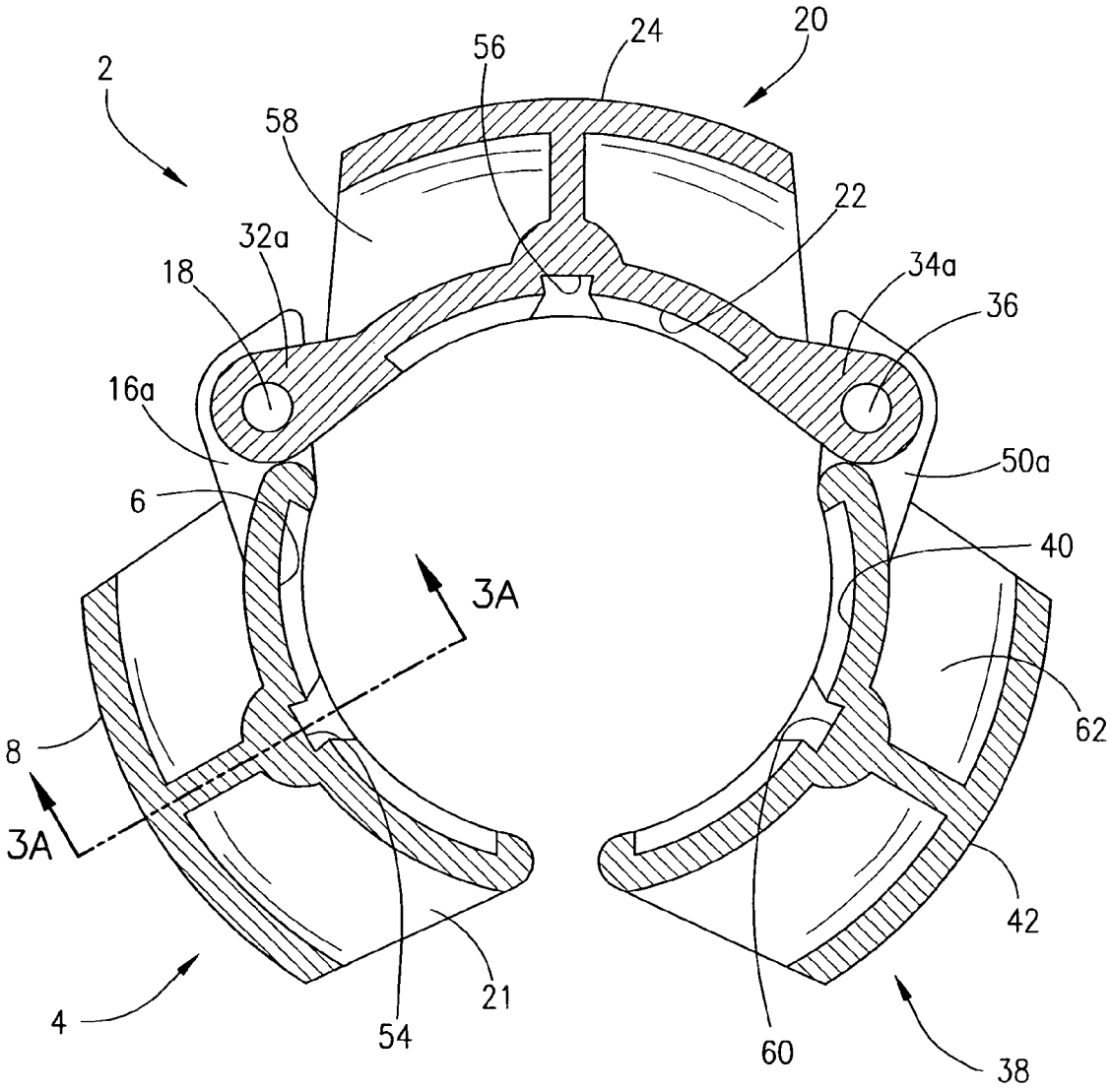
FIG. 2 is a cross-sectional view of the slips taken from line A—A of FIG. 1.

Referring now to FIG. 2, a cross-sectional view of the slips without inserts taken from line A—A of FIG. 1. It should be noted that like numbers appearing in the various figures refer to like components. Thus, there is shown the first slip 4 with the inner face 6, and further, the inner face 6 having a longitudinally disposed slot 54. The slot 54 will cooperate with the inserts, as will be explained later in the application. FIG. 2 also shows the rib 21 connecting the inner face 6 with the outer face 8, as previously noted. The first slip 4 is attached to the second slip 20 via hinge spring assembly 18 through the projections 16*a* of first slip 4 and the projections 32*a* of second slip 20.

Also shown in FIG. 2 is the second slip 20 with the inner face 22, and further, the inner face 22 having a longitudinally disposed slot 56. The slot 56 will cooperate with the inserts, as will be explained later in the application. FIG. 2 also shows the rib 58 connecting the inner face 22 with the outer face 24, as previously noted. The second slip 20 is attached to the third slip 38 via hinge spring assembly 36 through the projections 34*a* of second slip 20 and the projections 50*a* of third slip 38.

FIG. 2 also depicts the third slip 38 with the inner face 40, and further, the inner face 40 having a longitudinally disposed slot 60. The slot 60 will cooperate with the inserts, as will be explained later in the application. FIG. 2 also shows the rib 62 connecting the inner face 40 with the outer face 42, as previously noted.

Figure 3A:
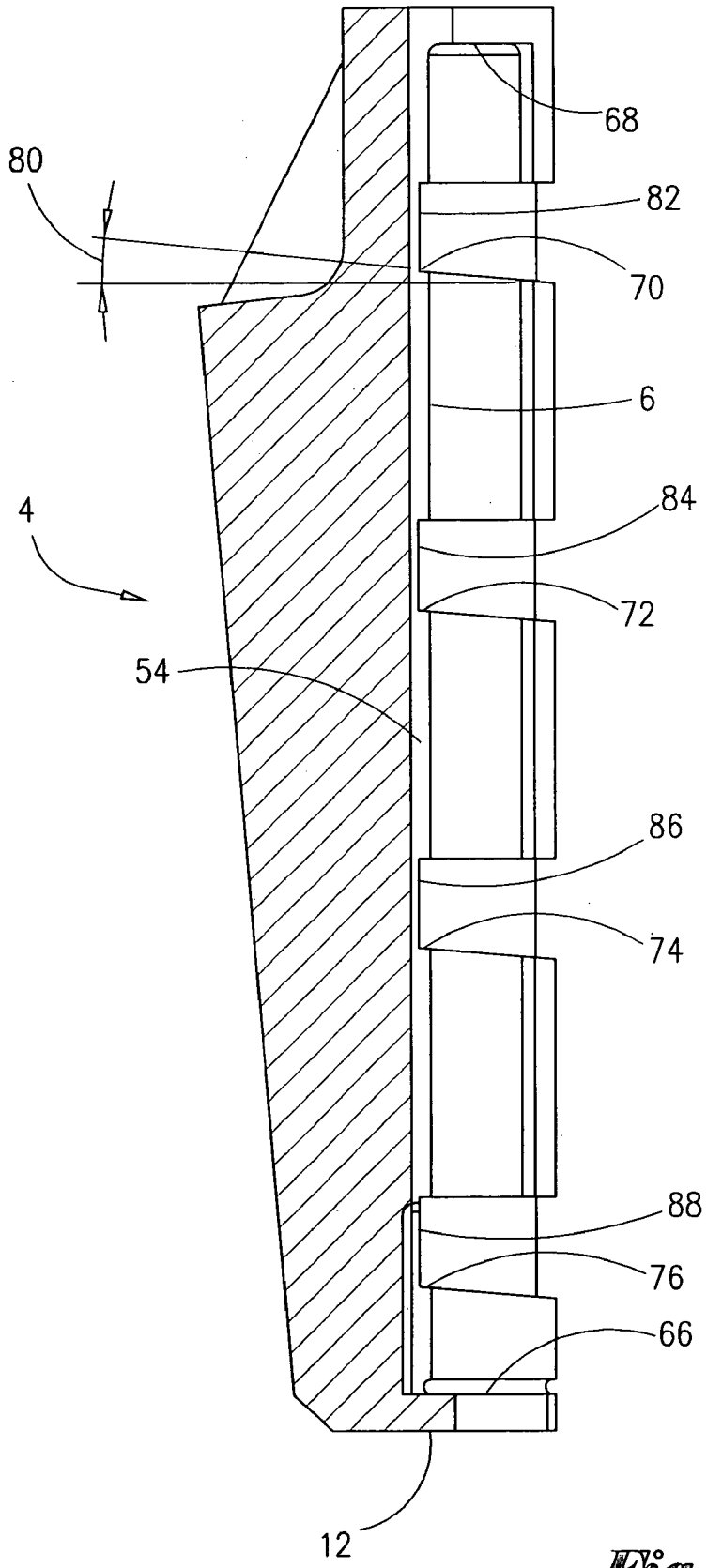
FIG. 3A is a side sectional view of a slip of the present invention without inserts.

Referring now to FIG. 3A, taken from line 3A—3A of FIG. 2, a side sectional view of the slip 4 without inserts will now be described. The FIG. 3A shows the arcuate outer face 8 tapering to the bottom end 12. FIG. 3A also depicts the arcuate inner face 6 along with the longitudinal slot 54. The arcuate inner face 6 extends to the bottom shelf 66 at one end and the arcuate inner face 6 extends to the top shelf 68 at the other end. The arcuate inner face 6 will have a plurality of ledges disposed therein, namely ledge 70, ledge 72, ledge 74, and ledge 76.

Each ledge has an angled surface, which in the preferred embodiment is between plus 20 degrees and minus 20 degrees, and in one of the preferred embodiments is 10 degrees as denoted by the numeral 80 in FIG. 3A. It should be noted that in the most preferred embodiment, the angle will be 0 degrees i.e. radially flat. The angle of the ledge will cooperate with and be complementary to the angle on the shoulder of the insert that will rest thereon, as will be explained in further detail later in the application. It should be noted that the ledge 70 has a backside surface 82 disposed within slot 54; ledge 72 has a backside surface 84; ledge 74 has a backside surface 86; and, ledge 76 has a backside surface 88. Further, it should be noted that while slip 4 and its features are explained with reference to FIG. 3A, all slips (namely slip 4, slip 20 and slip 38) will be of essentially similar construction.

Figure 3B:
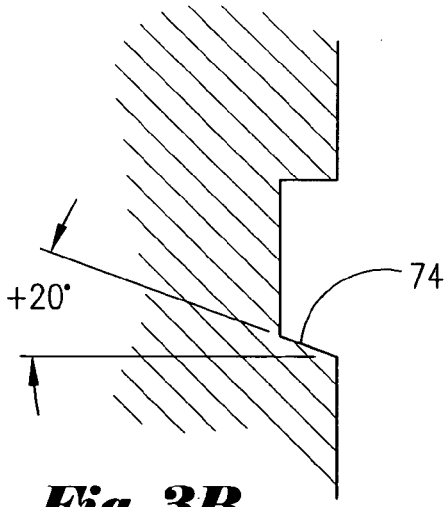
FIG. 3B is an enlarged view of one embodiment of the ledge seen in FIG. 3A.
Figure 3C:
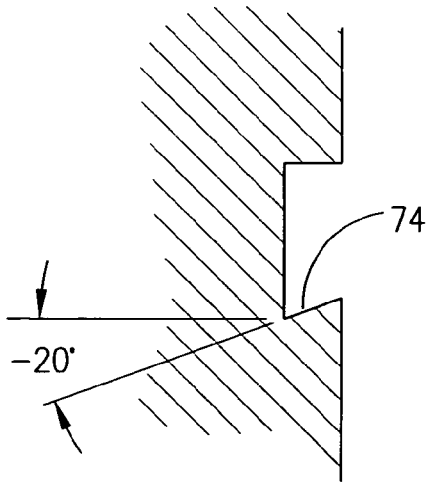
FIG. 3C is an enlarged view of a second embodiment of the ledge seen in FIG. 3A.

FIG. 3B is a enlarged view of one embodiment of the ledge seen in FIG. 3A. FIG. 3B depicts an angle of plus 20 degrees; for example, ledge 72 has an angle of 20 degrees. FIG. 3C is an enlarged view of another embodiment of the ledge seen in FIG. 3A. FIG. 3C depicts an angle of minus 20 degrees; for example, ledge 74 has an angle, in this embodiment, of minus 20 degrees.

Figure 4C:
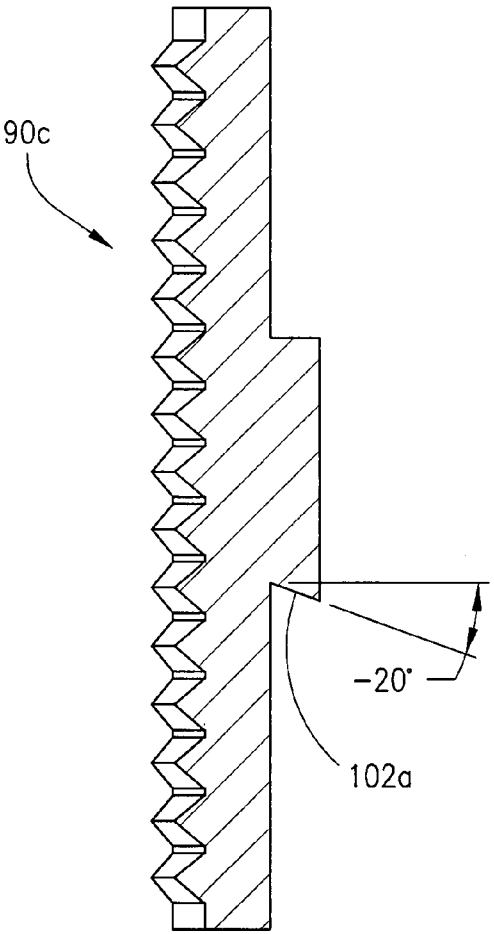
FIG. 4C is a cross-sectional view of a third embodiment of the insert of the present invention.
Figure 4B:
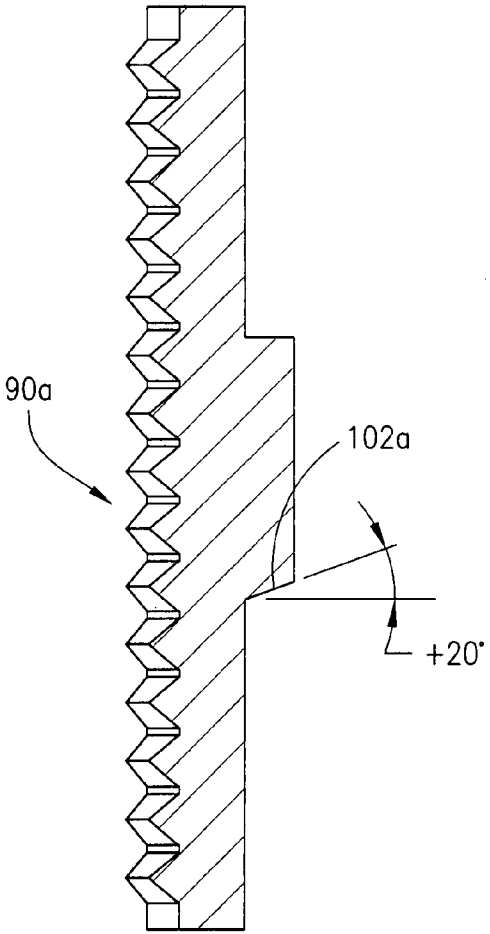
FIG. 4B is a cross-sectional view of a second embodiment of the insert of the present invention.
Figure 4A:
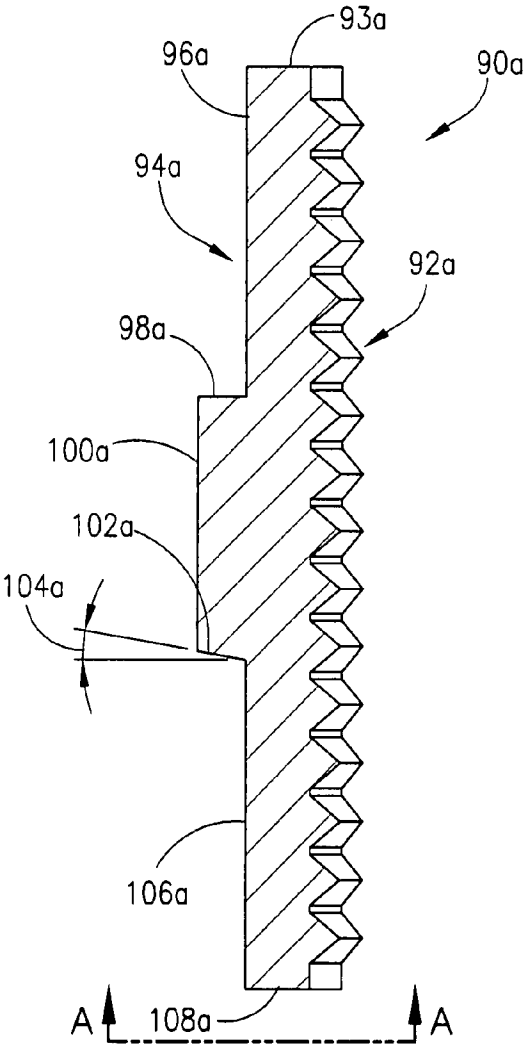
FIG. 4A is a cross-sectional view of a first embodiment of the insert of the present invention.

Referring now to FIG. 4A, a cross-sectional view of the insert 90*a*, which is the preferred embodiment of this invention, will now be described. Since the insert 90*a* is constructed to fit into the arcuate inner face 6, the insert 90*a* is also of arcuate construction. The insert 90*a* has an arcuate front side 92*a* that contains the slip face gripping means as is well under stood by those of ordinary skill in the art. The slip face gripping means includes teeth like projections arranged in rows for engaging with the tubular members.

The insert 90*a* has a top side 93*a* and an arcuate back side 94*a*, with the back side containing a first surface 96*a* that extends to the shoulder 98*a* which in turn extends to the second surface 100*a*. The second surface concludes at the angled shoulder 102*a*, with the angled shoulder being angled between plus 20 degrees and minus 20 degrees. In one of the preferred embodiments, the shoulder is disposed at a 10 degree angle as denoted by the numeral 104*a* as seen in FIG. 4A; as noted earlier, the most preferred embodiment is 0 degrees, i.e. radially flat. The angled shoulder 102*a* extends to the third surface 106*a*, with the surface 106*a* concluding at the bottom end 108*a*.

FIG. 4B depicts a cross-sectional view of a second embodiment of the insert of the present invention, and more particularly, shows the shoulder with a plus 20 degree angle. FIG. 4C is a cross-sectional view of a third embodiment of the insert of the present invention; thus, shoulder 102*a* has a 20 degree angle of inclination. FIG. 4C depicts the shoulder with a minus 20 degree angle; thus, the shoulder 102*a* with this embodiment has a minus 20 degree angle of inclination.

Figure 5:
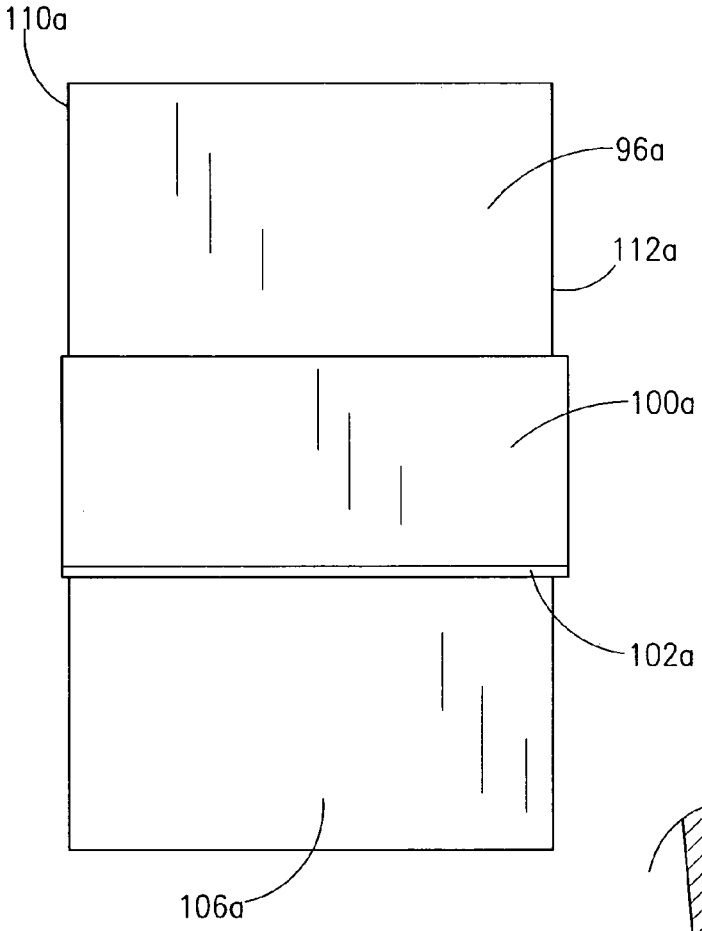
FIG. 5 is a back view of a preferred embodiment of an insert of the present invention.

Referring now to FIG. 5, a back view of the insert 90*a* seen in FIG. 4A will now be described. Thus, the first surface 96*a* is shown extending to the second surface 100*a* along with the angled shoulder 102*a* that in turn extends to the third surface 106*a*. FIG. 5 also depicts the side 110*a* and the side 112*a*.

Figure 6:
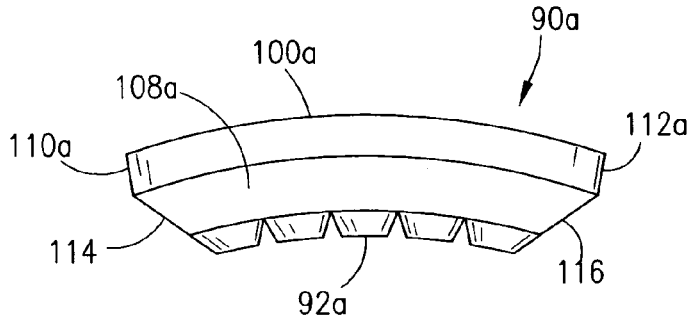
FIG. 6 is a bottom view of the preferred embodiment of the insert taken from line A—A of FIG. 4.

FIG. 6 depicts the bottom view of the insert 90*a* taken from line A—A of FIG. 4A. This view shows the arcuate nature of the insert 90*a*. For instance, the second surface 100*a* is shown arched. FIG. 6 also illustrates the arched front side 92*a* with the teeth projections. The bottom end 108*a* of insert 90*a* is also shown. The side 10*a* extends to the angled extension 114 and the side 112*a* extends to the angled extension 116.

Figure 7B:
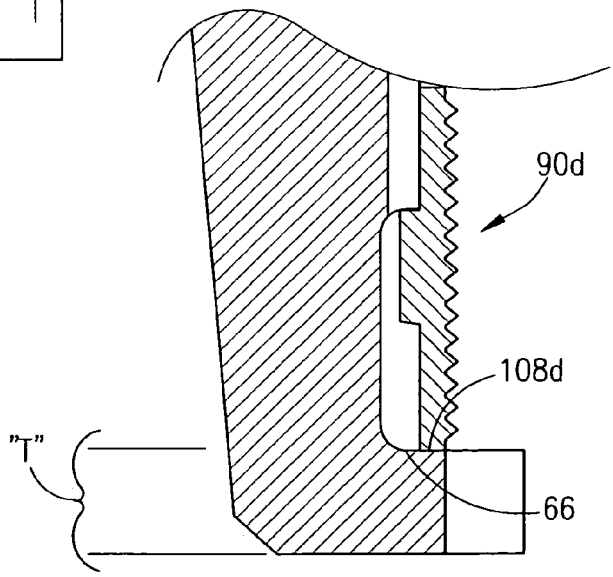
FIG. 7B is an enlarged view of the bottom end of the slip seen in FIG. 7A.
Figure 7A:
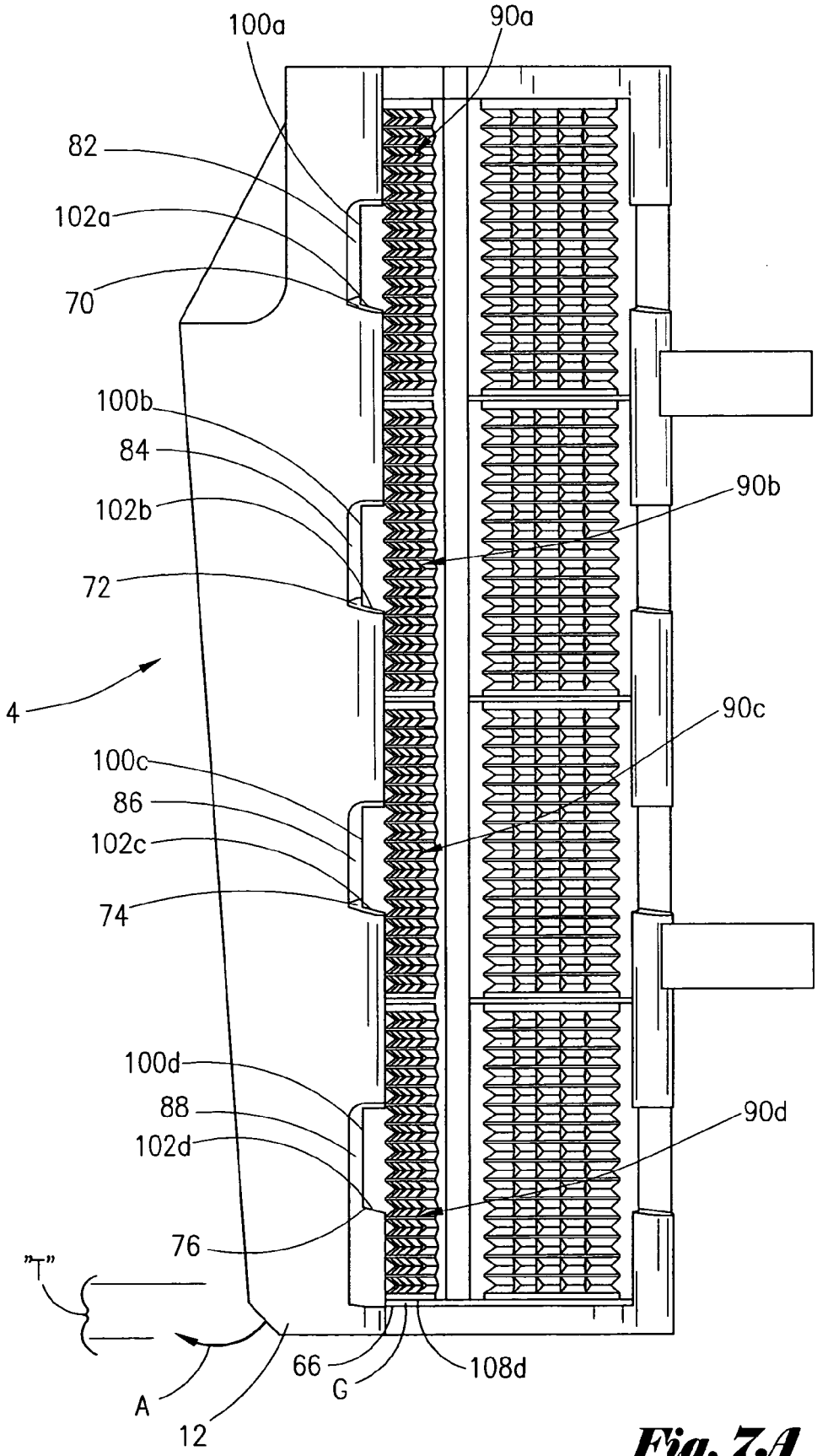
FIG. 7A is a side view of the slip from FIG. 3 with the inserts disposed therein.

With reference to FIG. 7A, the side view of the slip 4 from FIG. 3 with the inserts disposed therein will now be described. In particular, the shoulder 102*a* of insert 90*a* is abutting the ledge 70. Note that the angled shoulder 102*a*, which has a 10 degree angle, cooperates with the 10 degree angle of the ledge 70. Also, the second surface 100*a* is up against the backside surface 82.

With reference to the insert 90*b*, the second surface 100*b* is abutting the backside surface 84. The insert's angled shoulder 102*b* is abutting the ledge 72. Note that the 10 degree angle of shoulder 102*b* also cooperates with the 10 degree angle of the ledge 72. Referring to the insert 90*c*, the second surface 100*c* is up against the backside surface 86. The insert's angled shoulder 102*c* is abutting the ledge 74. As noted earlier, the angled shoulder 102*c* has a 10 degree angle that cooperates with the 10 degree angle of the ledge 74. With reference to the insert 90*d*, the second surface 100*d* abuts the backside surface 88. The angled shoulder 102*d* abuts the ledge 76. As shown, the 10 degree angle of shoulder 102*d* cooperates with the 10 degree angle of the ledge 76.

In prior art devices, the bottom section would deflect and/or bend outward as denoted by arrow "A"; this is known as "toeing". The bottom section "T" is seen in FIG. 7A. In the preferred embodiment, the gap "G" prevents the load from transferring to shelf 66 so that toeing is prevented. It is within the scope of this invention, however, that bottom end 108*d* would abut shelf 66 even though this is not shown in FIG. 7A (for instance, see FIG. 7B and FIG. 8). In the event that a gap did not exist, prior art toeing would still be prevented since the load is being distributed along the entire length of the slip according to the teachings of this invention i.e. the load is being distributed at ledges 70, 72, 74, 76.

FIG. 7B is an enlarged view of the bottom end of the slip seen in FIG. 7A with a slight difference: FIG. 7B depicts an enlarged view with the embodiment of the bottom end 108*d* abutting the shelf 66. In other words, the embodiment of FIG. 7B does not have a gap as seen in FIG. 7A.

Figure 8:
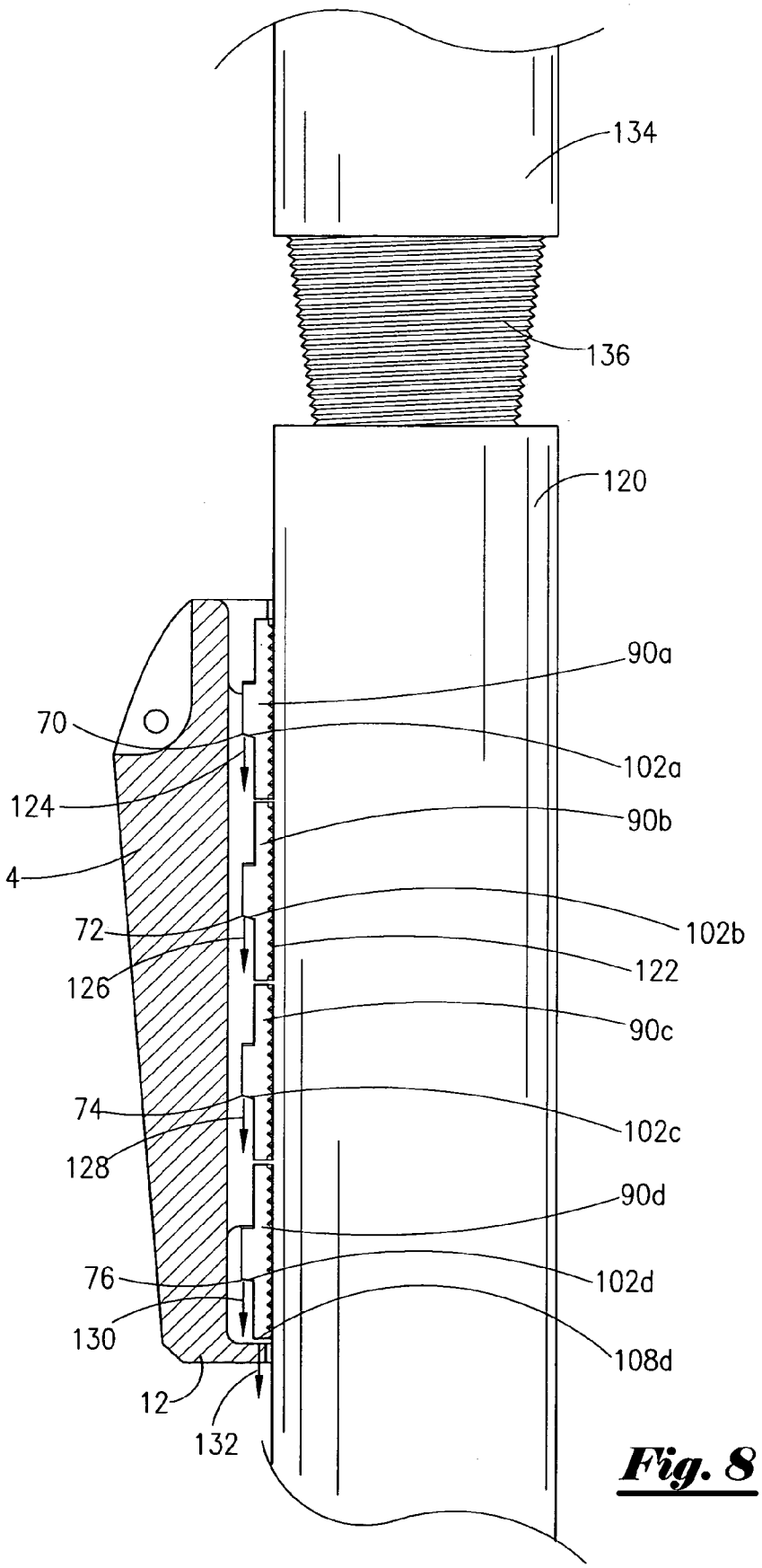
FIG. 8 is a partial cross-sectional view of the slip engaging a tubular member.

FIG. 8 will now be described. FIG. 8 is a partial cross-sectional view of the slip 4 engaging a tubular member 120. The tubular member 120 is inserted into the rotary table on the drill floor and the slip device is inserted into the rotary table. The teeth like projections, such as seen at 122, engage the slip 4 as well as the other two slips 20, 38 (which are not shown in this view) thereby suspending the tubular member 120 from the rotary table. The load of the tubular member 120 will be transferred from the teeth 122, to the inserts, for instance to insert 90*a*, then to the angled shoulder 102*a* which in turn is transferred to the ledge 70 of the arcuate inner face 6 of slip 4. The arrow 124 depicts the point where the load is transferred from the shoulder 102*a* to the ledge 70.

With respect to the insert 90*b*, the load will be transferred from the teeth of insert 90*b*, then to the angled shoulder 102*b* which in turn is transferred to the ledge 72 of the arcuate inner face 6 of slip 4. Arrow 126 illustrates the point where the load is transferred from the shoulder 102*b* to the ledge 72. With respect to the insert 90*c*, the load will be transferred from the teeth of insert 90*c*, then to the angled shoulder 102*c* which in turn is transferred to the ledge 74 of the arcuate inner face 6 of slip 4. Arrow 128 illustrates the point where the load is transferred from the shoulder 102*c* to the ledge 74.

Referring to the insert 90*d*, the load will be transferred from the teeth of insert 90*d*, then to the angled shoulder 102*d* which in turn is transferred to the ledge 76 of the arcuate inner face 6 of slip 4. The arrow 130 illustrates the point where the load is transferred from the shoulder 102*d* to the ledge 76. In one embodiment, the bottom end 108*d* of the insert 90*d* also transfers the load to the bottom end 12 of the slip 4 denoted by arrow 132; however, the load has been reduced due to the novel construction, namely the distribution along the entire length of the arcuate inner face 6 which allows for a much improved slip. It should be noted that a gap is depicted in FIG. 8.

As noted earlier, it is possible to have a gap between 108*d* and bottom shelf 66 (as seen in FIG. 7A), wherein no load is transferred to this bottom shelf which would prevent any deformation of the bottom shelf 66. However, with the embodiment of FIG. 8, some of the load is transferred as denoted by arrow 132.

In normal operations, a second tubular member 134 may also be threadedly connected to the first tubular member via external threads 136 as will be readily understood by those of ordinary skill in the art. After threadedly connecting the two tubulars, the operator lifts the tubulars and then removes the slip device from the rotary table. The connected tubulars are then lowered to the desired level. The slip 2 may again be inserted into the rotary table as understood by those of ordinary skill in the art.

Figure 9:
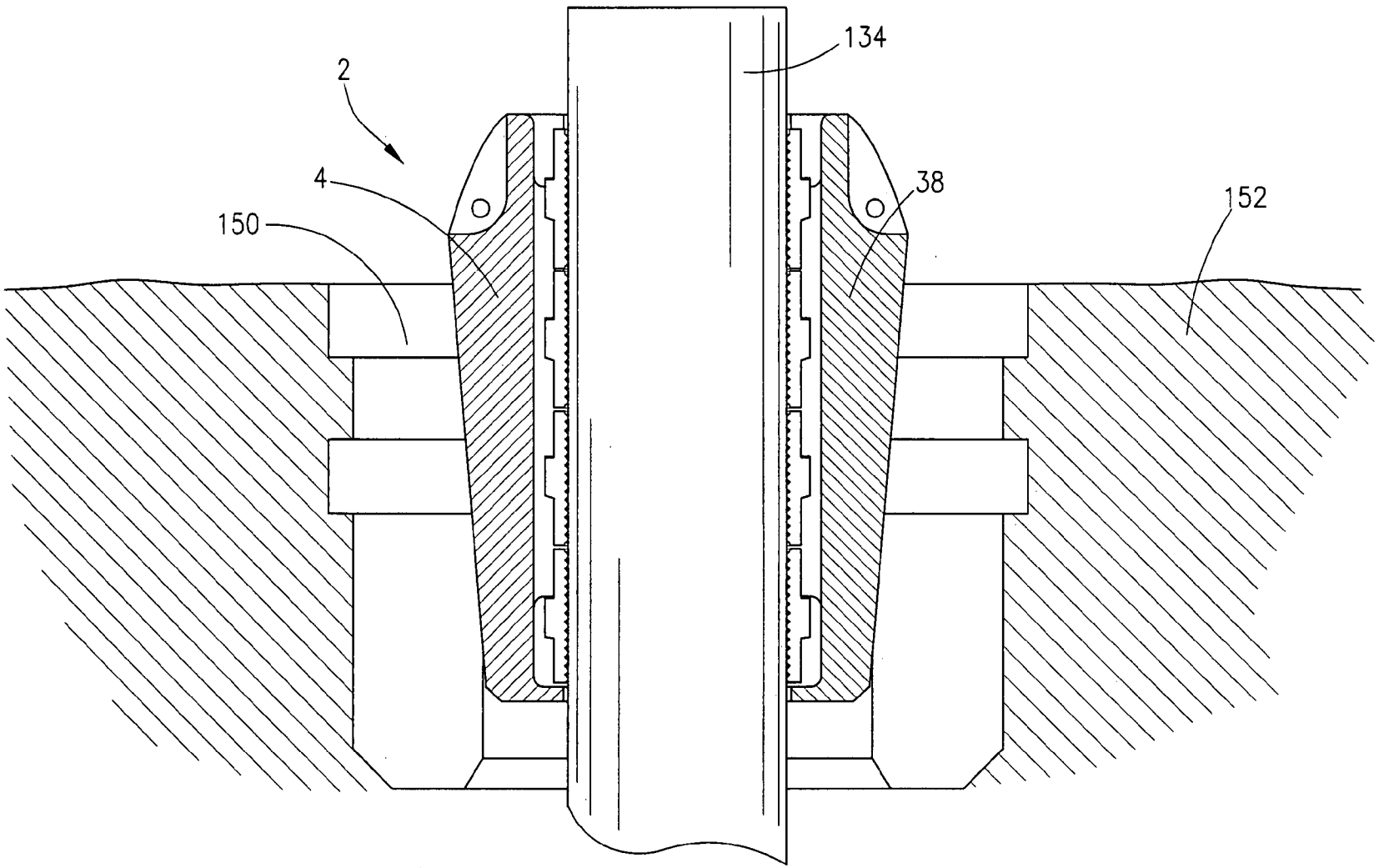
FIG. 9 is a partial cross-sectional view of the slips engaging a tubular member within a slip bowl.

FIG. 9 is a partial cross-sectional view of the slips engaging a tubular member within a slip bowl. The rotary slip 2 is configured to fit into the rotary bowl 150 which in turn is set into the rotary bushing and rotary table on the rig floor, as is understood by those of ordinary skill in the art. This view shows the that the slips engage the tubular member 134. The rotary slip 2 is then again inserted into the rotary bowl 150 and the rotary slip 2 is positioned to surround the second tubular member 134. Further lowering of the tubular member 134 causes the slip device 2 to also be lowered into the rotary bowl 150. Due to the wedge shaped design, the slip device 2 engages the tubular without the tubular falling through the slip bowl 150. The load of this tubular string (namely the tubular 120 and tubular 134) will be distributed about the ledges contained within each individual slip, namely slip 4, slip 20, and slip 38 as previously described. For instance, for the slip 4 of FIG. 8, the load is distributed about the ledges 70, 72, 74 and 76, and shelf 66.

FIG. 10 depicts a partial cross-sectional view of a hinge spring assembly 160. The hinge spring assembly is the type used as the hinge spring assembly 18 seen in FIG. 1 and the hinge spring assembly 36 also seen in FIG. 1. The hinge spring assembly 160 is used to connect the slips, as previously noted. The hinge spring assembly tend to bind the slips together. The hinge spring assembly 160 is commercially available from Access Oil Tools Inc. under the part number 03-108.

Figure 11:
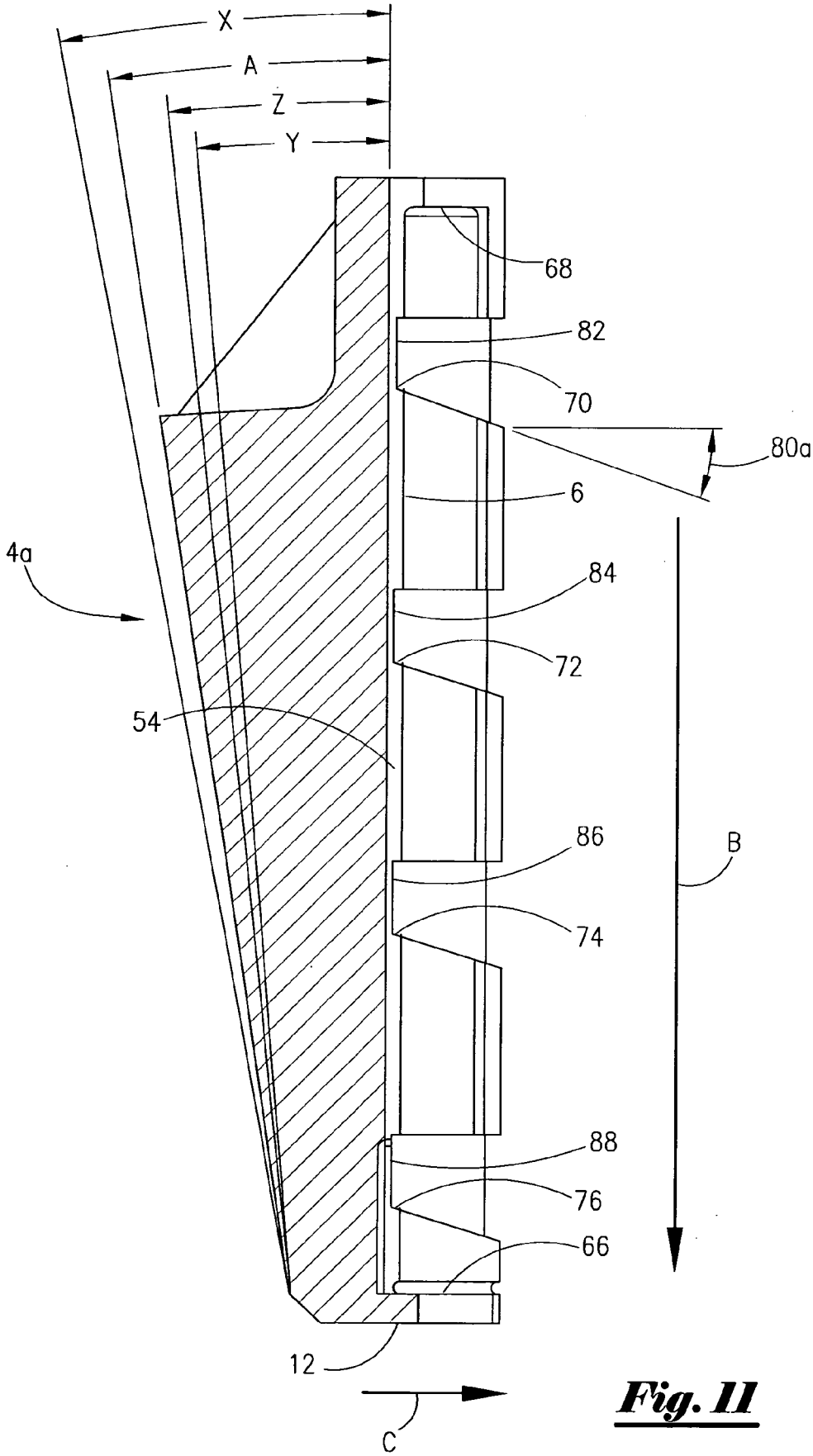
FIG. 11 is a side sectional view of a slip of a second embodiment, which is the most preferred embodiment of the present invention, without inserts.

Referring now to FIG. 11, a side sectional view of a second embodiment, which is the most preferred embodiment of this application, of the slip 4*a* will now be described. In FIG. 11, the slip 4*a* is shown without inserts. More specifically, FIG. 11 depicts a taper angle of the outer slip 4*a* of approximately 12 degrees relative to the vertical axis as denoted by "A". According to the teachings of this invention, the outer portion of the slip in one embodiment may have a taper of greater than 11 degrees; in one preferred embodiment, the taper is between 11 degrees and 15 degrees; and in the most preferred embodiment, the taper is 12 degrees (as denoted by "A"). It should be noted that the 15 degree taper is denoted by "X".

Conventional slips have a three inch (7.12502 degrees relative to the vertical axis as seen by "Y") or four inch (9.46232 degrees relative to the vertical axis as seen by "Z") taper per foot. This means for every twelve inches of vertical height at the top of the slip, the slip is three or four inches larger in diameter than the bottom, which is essentially the taper of the slip and bowl insert shown in the FIGS. 1 through 10 of the present invention.

The taper is what helps to create the wedge effect in the bowl that suspends the pipe while connections are made to create the wedge effect in the bowl that suspends the pipe while connections are made to extend or shorten the drill string when going in or coming out of the hole. Prior art tapers (3 or 4 inch tapers) worked very well for a long time in the oil field. However, with the advent of deepwater drilling and running long strings of casing down to the ocean floor on the bottom of a string of pipe, crushing of the drill pipe and/or slip failure has become a major issue. The prior art 3 inch or 4 inch taper slip worked well on conventional wells, but because of the extreme loads and the minimal angle on the slip back and insert bowl, the crushing effect is at a dangerous level. When the angle on the back of the slip and the angle in the slip bowl is increased, the crushing effect is lessened. But, with the angle increase, it is also harder to get the slips to set (pipe locked into slips) on the pipe especially when there is a light load on them. When running a landing string, there is already sufficient weight on the pipe to set the slips. With a conventional 4 inch taper slip, there is an approximately 3 to 1 force factor, i.e. when there is a 1000 pounds of axial force (vertical, weight pulling down), there is approximately 3000 pounds of transverse force (horizontal, load applied outward). In the invention herein disclosed, with a 12 degree taper (5.10136 inch taper per foot), there is an approximately 2 to 1 force factor. For instance, when there is a 1000 pounds axial force (vertical, weight pulling down as seen by arrow "B") there is a 2000 pound transverse force (horizontal, load applied axially outward as seen by arrow "C"). It is the transverse force that produces the gripping effect of the slips to hold the pipe from falling in the hole and it also is the same force that crushed the pipe. If the pipe starts to crush enough, then the slips will also start to fail because of the improper loading. When this starts to happen then there is a domino effect that takes place and both problems are accelerated.

As noted earlier, like numbers appearing in the application refer to like components. Hence, FIG. 11 shows the arcuate outer face 8 tapering to the bottom end 12. FIG. 11 also depicts the arcuate inner face 6 along with the longitudinal slot 54. The arcuate inner face 6 extends to the bottom shelf 66 at one end and the arcuate inner face 6 extends to the top shelf 68 at the other end. The arcuate inner face 6 will have a plurality of ledges disposed therein, namely ledge 70, ledge 72, ledge 74, and ledge 76.

Each ledge may have an angled surface, which is 20 degrees as denoted by the numeral 80*a* in FIG. 11. The angle of the ledge will cooperate with and be complementary to the angle on the shoulder of the insert that will rest thereon, as was explained earlier. It should be noted that the ledge 70 has a backside surface 82 disposed within slot 54; ledge 72 has a backside surface 84; ledge 74 has a backside surface 86; and, ledge 76 has a backside surface 88. Further, it should be noted that while slip 4*a* and its features are explained with reference to FIG. 11, all slips (namely slip 4, slip 20 and slip 38) will be of essentially similar construction in this second preferred embodiment, except as to the outer taper and angle of the ledge.

Figure 12:
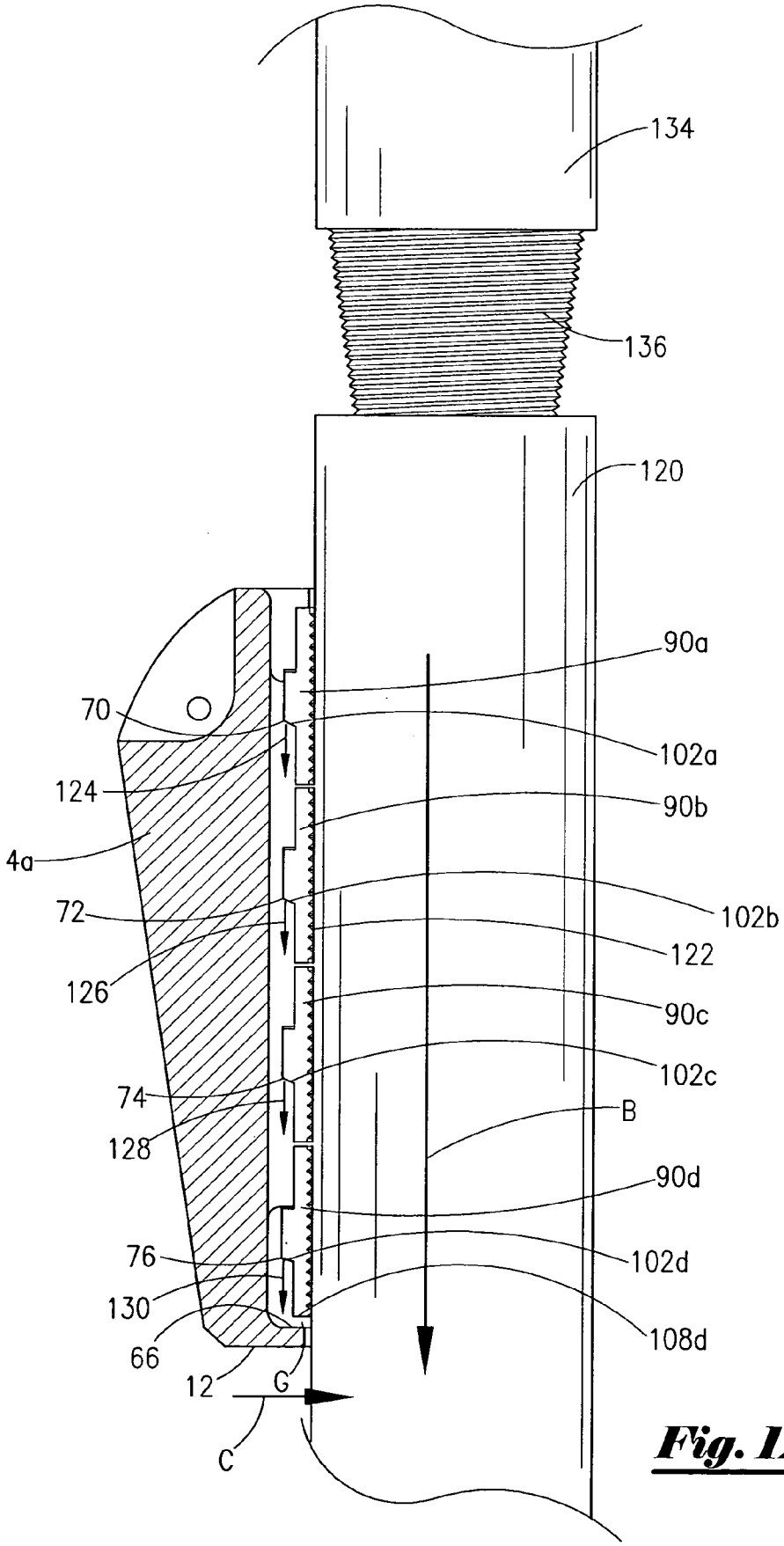
FIG. 12 is a partial cross-sectional view of the slip embodiment shown in FIG. 11 engaging a tubular member.

FIG. 12 will now be described. FIG. 12 is a partial cross-sectional view of the slip embodiment shown in FIG. 11 engaging a tubular member 120. FIG. 12 is similar to previously discussed FIG. 8, except with the taper angle of the outer portion of slip 4*a* being 12 degrees. The slip device is inserted into the modified rotary bowl within the rotary table. The teeth like projections, such as seen at 122, engage the slip 4 as well as the other two slips 20, 38 (which are not shown in this view) thereby suspending the tubular member 120 from the rotary table. The load of the tubular member 120 will be transferred from the teeth 122, to the inserts, for instance to insert 90*a*, then to the angled shoulder 102*a* which in turn is transferred to the ledge 70 of the arcuate inner face 6 of slip 4 as previously explained. The arrow 124 depicts the point where the load is transferred from the shoulder 102*a* to the ledge 70.

With respect to the insert 90*b*, the load will be transferred from the teeth of insert 90*b*, then to the angled shoulder 102*b* which in turn is transferred to the ledge 72 of the arcuate inner face 6 of slip 4. Arrow 126 illustrates the point where the load is transferred from the shoulder 102*b* to the ledge 72. With respect to the insert 90*c*, the load will be transferred from the teeth of insert 90*c*, then to the angled shoulder 102*c* which in turn is transferred to the ledge 74 of the arcuate inner face 6 of slip 4. Arrow 128 illustrates the point where the load is transferred from the shoulder 102*c* to the ledge 74.

Referring to the insert 90*d*, the load will be transferred from the teeth of insert 90*d*, then to the angled shoulder 102*d* which in turn is transferred to the ledge 76 of the arcuate inner face 6 of slip 4. The arrow 130 illustrates the point where the load is transferred from the shoulder 102*d* to the ledge 76. In one embodiment, the bottom end 108*d* of the insert 90*d* also transfers the load to the bottom end 12 of the slip 4 denoted by arrow 132; however, the load "B" has been reduced due to the novel construction, namely the distribution along the entire length of the arcuate inner face 6 which allows for a much improved slip. It should be noted that a gap "G" is depicted in FIG. 12.

As noted earlier, it is possible to have a gap between 108*d* and bottom shelf 66 (as also seen in FIG. 7A), wherein no load is transferred to this bottom shelf which would prevent any deformation of the bottom shelf 66. Also, the transverse (horizontal) load, denoted by arrow "C" has been reduced so that in heavy weight applications, such as landing string, the crushing force ("C") has been reduced due to the novel taper of the slip and corresponding bowl insert (not seen in this view).

In normal operations, a second tubular member 134 may also be threadedly connected to the first tubular member via external threads 136 as will be readily understood by those of ordinary skill in the art. After threadedly connecting the two tubulars, the operator lifts the tubulars and then removes the slip device from the rotary table. The connected tubulars are then lowered to the desired level. The slip 2 may again be inserted into the rotary table as understood by those of ordinary skill in the art.

Figure 13:
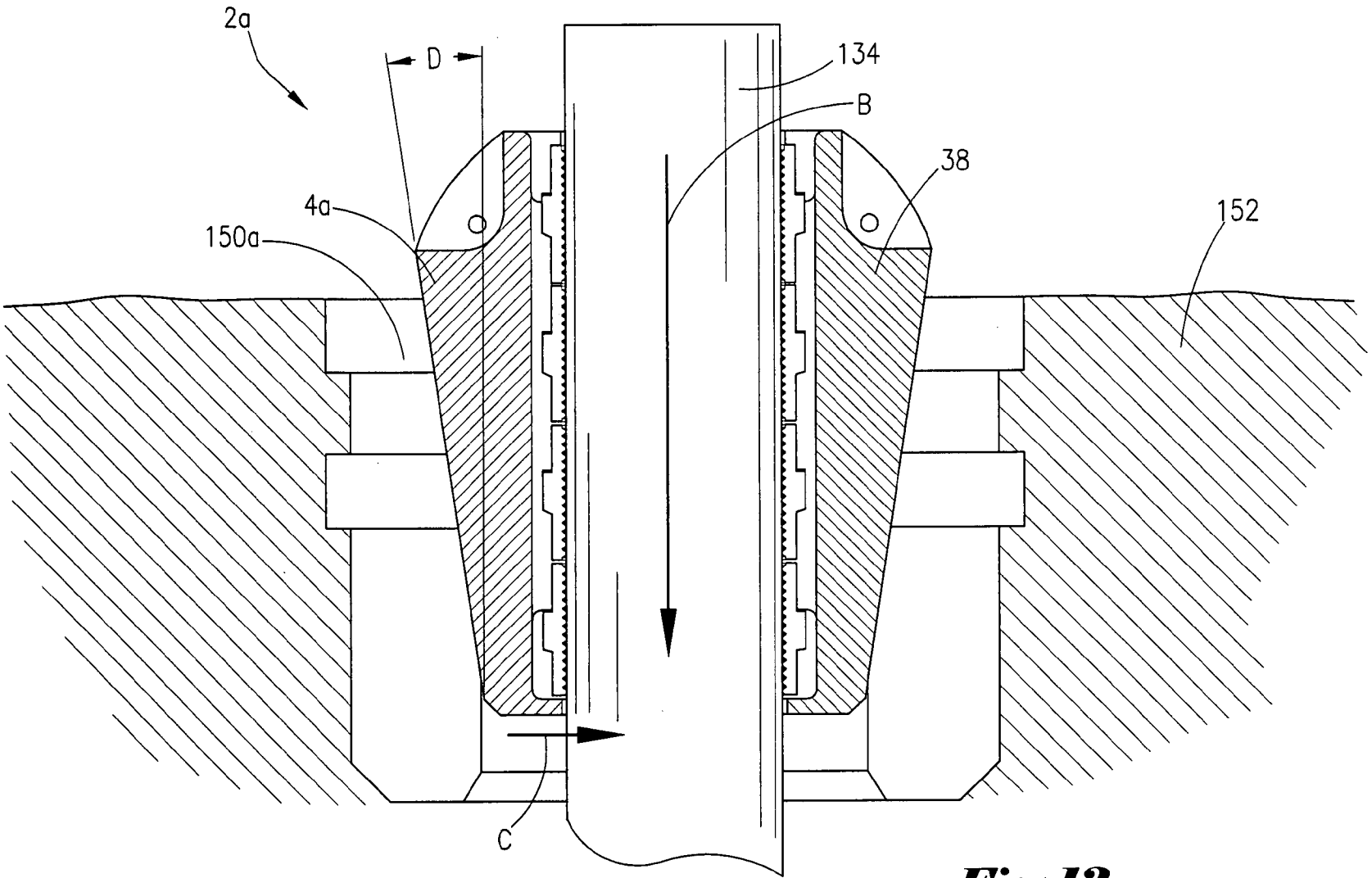
FIG. 13 is a partial cross-sectional view of the slip embodiment shown in FIGS. 11 and 12 engaging a tubular member within a slip bowl.

FIG. 13 is a partial cross-sectional view of the slip embodiment shown in FIGS. 11 and 12 engaging a tubular member within a slip bowl. The rotary slip device 2*a* is configured to fit into the rotary bowl 150*a* which in turn is set into the rotary bushing and rotary table on the rig floor, as is understood by those of ordinary skill in the art. The inner portion of rotary bowl 150*a* contains the reciprocal taper, which in the embodiment shown is 12 degrees relative to the vertical axis, designated by the letter "D". This view shows that the slips engage the sequential tubular member 134. The rotary slip device 2*a* is inserted into the rotary bowl 150*a* and the rotary slip device 2*a* is positioned to surround the second tubular member 134. Further lowering of the tubular member 134 causes the slip device 2*a* to also be lowered into the rotary bowl 150*a*. Due to the wedge shaped design, the slip device 2*a* engages the tubular without the tubular falling through the slip bowl 150. The load of this tubular string (namely the tubular 120 and tubular 134) will be distributed about the ledges contained within each individual slip, namely slip 4, slip 20, and slip 38 as previously described. For instance, for the slip 4*a* of FIG. 12, the load "B" is distributed about the ledges 70, 72, 74 and 76, and shelf 66. As noted earlier, the transverse load "C" is also reduced due to the taper of the slip 2*a* and the corresponding bowl insert 150*a*. Thus, by distributing the axial load "B" and reducing the transverse load "C", these heavy strings of tubulars, such as landing strings, can be safely lowered and raised as per the teachings of the present invention.

Figure 14:
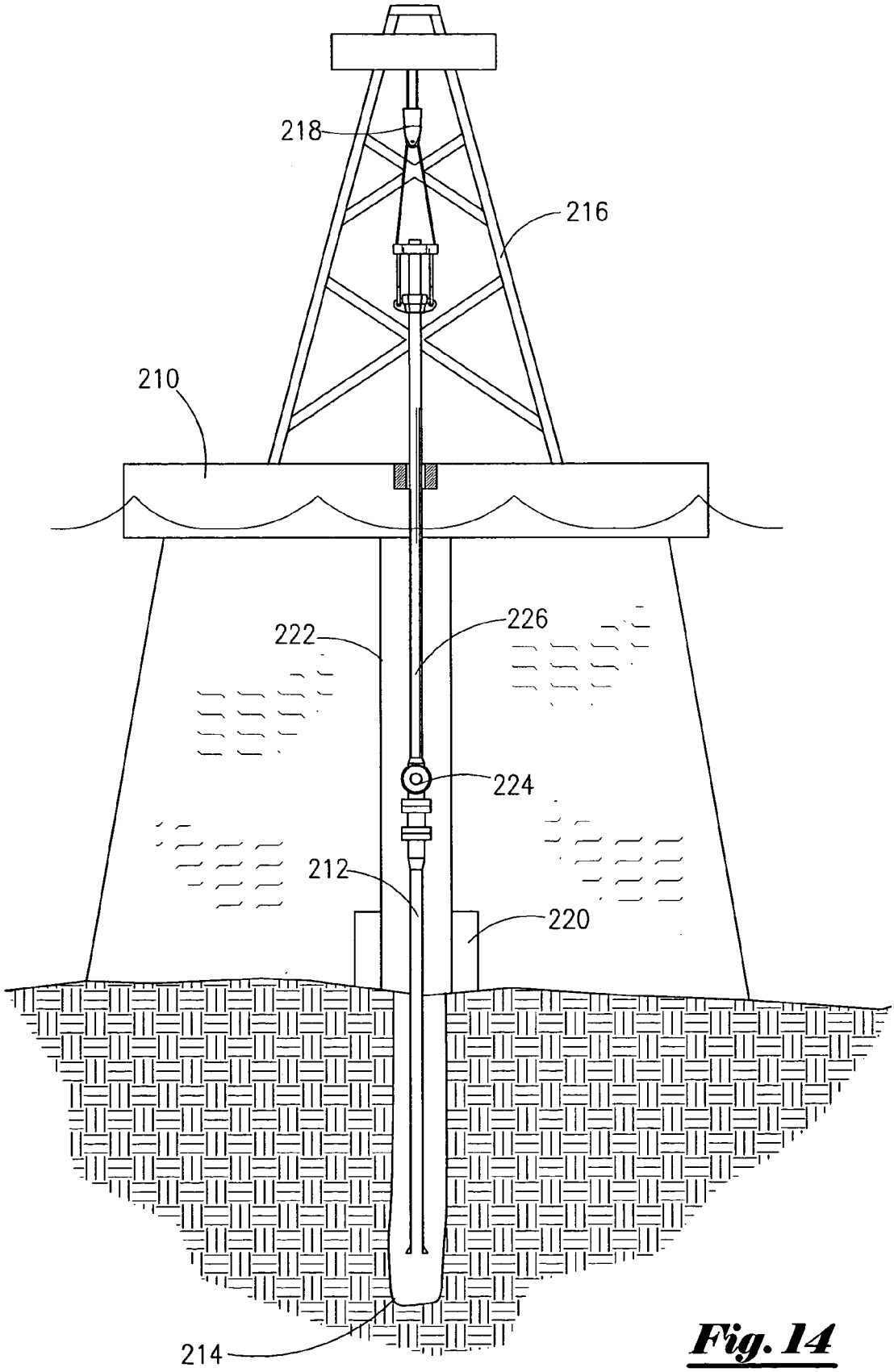
FIG. 14 is a schematic view of a floating platform lowering a tubular string into a well in accordance with the teachings of the present invention.

In FIG. 14, a schematic view of a floating platform 210 lowering a tubular string 212 into a well 214 in accordance with the teachings of the present invention will now be described. The tubular string 212, in one preferred embodiment, will be a casing string, and the floating platform 210 will contain a drilling rig 216. The drilling rig 216 will contain a hoisting system that includes the block 218. A sub-sea tree 220 is position on the ocean floor, and wherein a marine riser 222 extends from the sub-sea tree on the ocean floor to the floating platform 210.

The method of landing a casing string 212 into a sub-sea well head 220 from the floating platform 210 includes running the casing string 212 into the marine riser 222 and connecting a casing hanger 224 to the casing string 112. A casing hangar is a device that serves to connect with and anchor to the casing string to the sub-sea tree, and casing hangers are commercially available from Cooper Cameron Inc. under the name casing hanger.

The method further includes attaching the landing string 226 to the casing hanger 224. As noted earlier, the landing string 226 is a tubular member that is used to lower into proper position a down hole component. The down hole component may be a casing string, bottom hole assembly containing a measurement while drilling tool with bit and mud motor, etc. The landing string 226 may be referred to sometimes as a work string. In some embodiments, the landing string 226 is a specially sized drill pipe.

The operator would thereafter lower the landing string 226 through the marine riser 222. The landing string will be threadedly connected, as previously described, and the landing string will be run into the well as understood by those of ordinary skill in the art. Next, the casing hanger 224 can be landed into the sub-sea well head 220. The tubular string 212 has been lowered, therefore to a predetermined depth safely without risk of damage to the slips or crushing of the landing string due to the design of the slip 2*a* and rotary bowl 150*a*.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

We claim:

1. An apparatus for handling a landing string disposed within a rotary table on a rig, and wherein said landing string is attached to a bottom hole assembly disposed within a well, said landing string and said bottom hole assembly creating a load, the apparatus comprising:

a bowl insert having an inner portion, said inner portion having a taper of greater than 11 degrees relative to vertical;

slip means having a plurality of die inserts for engaging the work string within the rotary table, said slip means having an outer portion configured to fit into said inner portion of said bowl insert, said outer portion having a taper complementary of the bowl insert taper;

wherein said slip means comprises a first slip with a first and second ledge and having a first longitudinal disposed slot that extends the length of said first slip, and wherein said first and second ledge contain a backside; a second slip with a first and second ledge and having a second longitudinal disposed slot that extends the length of said second slip, and wherein said first and second ledge contains a backside; a third slip with a first and second ledge and having a third longitudinal disposed slot that extends the length of said third slip, and wherein said first and second ledge contains a backside; a first insert with a shoulder that cooperates with and abuts said backside of the first ledge of the first slip; a second insert with a shoulder that cooperates with and abuts said backside of the second ledge of the first slip; a third insert with a shoulder that cooperates with and abuts said backside of the first ledge of the second slip; a fourth insert with a shoulder that cooperates with and abuts said backside of the second ledge of the second slip; a fifth insert with a shoulder that cooperates with and abuts said backside of the first ledge of the third slip; a sixth insert with a shoulder that cooperates with and abuts said backside of the second ledge of the third slip, and wherein said shoulders are capable of transferring the load from said shoulders to said ledges.

2. The apparatus of claim 1 wherein said inner portion taper of said bowl insert is between 11 degrees and 15 degrees relative to vertical.

3. The apparatus of claim 1 wherein said outer portion taper of said slip means is between 11 degrees and 13 degrees relative to vertical.

4. The apparatus of claim 1 wherein said inner portion taper of said bowl insert is 12 degrees relative to vertical and said outer portion taper of said slip means is a complimentary angle of 12 degrees.

5. The apparatus of claim 1 wherein said slip means comprises a first, second and third slip means containing a plurality of dies for engaging the work string.

6. The apparatus of claim 1 wherein said bottom hole assembly is a casing string.

7. The apparatus of claim 6 wherein said landing string is a drill string.

8. The apparatus of claim 7 wherein said rig is a floatable rig situated on an ocean, above an ocean floor.

9. The apparatus of claim 8 wherein said drill string contains a casing hanger adapted to engage a sub sea tree on the ocean floor.

10. A tubular handling device comprising:

a first slip having an arcuate inner face and an outer face, wherein said inner face has a first longitudinally disposed slot and wherein said first longitudinally disposed slot has a first ledge that has a backside and wherein said first slip has an outer portion having a taper of greater than 11 degrees relative to vertical;

a second slip being connected to said first slip, said second slip having an arcuate inner face and an outer face, wherein said inner face has a second longitudinally disposed slot and wherein said second longitudinally disposed slot has a second ledge that has a backside therein and wherein said second slip has an outer portion having a taper of greater than 11 degrees relative to vertical;

a third slip having an arcuate inner face and outer face, wherein said inner face has a third longitudinally disposed slot and wherein said third longitudinally disposed slot has a third ledge that has a backside therein and wherein said third slip has an outer portion having a taper of greater than 11 degrees relative to vertical;

means for connecting said first slip with said second slip and means for connecting said second slip with said third slip;

a first insert having a first shoulder that is configured to fit within said first ledge and abut said backside of said first ledge, and wherein said first insert is capable of transferring a load from said first shoulder to said first ledge;

a second insert having a second shoulder that is configured to fit within said second ledge and abut said backside of said second ledge and wherein said second insert is capable of transferring a load from said second shoulder to said second ledge;

a third insert having a third shoulder that is configured to fit within said third ledge and abut said backside of said third ledge and wherein said third insert capable of transferring a load from said third shoulder to said third ledge;

a fourth insert having a fourth shoulder that is configured to fit within a fourth ledge that is disposed within said first longitudinally disposed slot, said fourth ledge having a backside and wherein said fourth insert abuts said backside and is capable of transferring a load from said fourth shoulder to said fourth ledge;

a fifth insert having a fifth shoulder that is configured to fit within a fifth ledge that is disposed within said second longitudinally disposed slot, said fifth ledge having a backside and wherein said fifth insert abuts said backside and is capable of transferring a load from said fifth shoulder to said fifth ledge;

a sixth insert having a sixth shoulder that is configured to fit within a sixth ledge that is disposed within said third longitudinally disposed slot, said sixth ledge having a backside and wherein said sixth insert abuts said backside and is capable of transferring a load from said sixth shoulder to said sixth ledge.

11. The tubular handling device of claim 10 wherein said first, second, third, fourth, fifth, and sixth ledge has a bottom surface having an angle between minus 20 degrees to plus 20 degrees relative to a horizontal plane and wherein said first, second, third, fourth, fifth, and sixth shoulder on said inserts has a complimentary angle of between minus 20 degrees to plus 20 degrees.

12. The tubular handling device of claim 11 wherein said inserts are constructed of a low carbon alloy steel material.

13. The tubular handling device of claim 12 wherein said first insert has a first handle member, and said second insert has a second handle member.

14. The tubular handling device of claim 10 further comprising a bowl insert having an inner portion having a mating taper of greater than 11 degrees, and wherein said first, second and third slips are disposed within said bowl insert.

15. A rotary slip apparatus for handling tubular members on a drill rig floor, the rotary slip apparatus comprising:

a first slip having a first arcuate inner face and an outer face, wherein said inner face has a first longitudinally disposed slot and wherein said first longitudinally disposed slot has a first ledge that has a backside and wherein said first slip has an outer portion having a taper of greater than 11 degrees;

a second slip being connected to said first slip, said second slip having a second arcuate inner face and an outer face and wherein said second slip has an outer portion having a taper of greater than 11 degrees, wherein said inner face of said second slip has a second longitudinally disposed slot and wherein said second longitudinally disposed slot has a second ledge that has a backside,;

a third slip having a third arcuate inner face and outer face and wherein said third slip has an outer portion having a taper of greater than 11 degrees, wherein said inner face of said third slip has a third longitudinally disposed slot and wherein said third longitudinally disposed slot has a third ledge that has a backside;

first means for attaching said first slip with said second slip and second means for attaching said second slip with said third slip;

a first insert having a first shoulder that is configured to fit within said first ledge, and wherein said first shoulder abuts said backside of said first ledge and transfers a load from said first insert to said first ledge;.

a second insert having a second shoulder that is configured to fit within said second ledge and wherein said second shoulder abuts said backside of said second ledge and transfers the load from said second insert to said second ledge;

a third insert having a third shoulder that is configured to fit within said third ledge and wherein said third shoulder abuts said backside of said third ledge and transfers a load from said third insert to said third ledge;

a fourth insert having a fourth shoulder that is configured to fit within a fourth ledge disposed within said first longitudinally disposed slot, and wherein said fourth shoulder abuts said backside of said fourth ledge and transfers the load from said fourth insert to said fourth ledge;

a fifth insert having a fifth shoulder that is configured to fit within a fifth ledge disposed within said second longitudinally disposed slot of said second slip and wherein said fifth shoulder abuts said backside of said fifth ledge and transfers the load from said fifth insert to said fifth ledge;

a sixth insert having a sixth shoulder that is configured to fit within a sixth ledge disposed within said third longitudinally disposed slot of said third slip and wherein said sixth shoulder abuts said backside of said sixth ledge and transfers a load from said first insert to said sixth ledge.

16. The rotary slip apparatus of claim 15 wherein said first insert, said second insert, and said third insert are constructed of a low carbon alloy steel material.

17. The rotary slip apparatus of claim 16 wherein said first, second, and third ledge has a bottom surface having an angle of minus twenty (−20) degrees to twenty (20) degrees relative to a horizontal plane and wherein said first shoulder, second shoulder and third shoulder on said first insert, said second insert and said third insert has a complimentary angle of minus twenty (−20) degrees to twenty (20) degrees.

18. A method of engaging a tubular member within a rotary table on a drill rig floor comprising:

providing a slip device, said slip device comprising: a first slip having an arcuate inner face and an outer face, wherein said inner face has a first longitudinally disposed slot that extends the length of said slip and wherein said first longitudinally disposed slot has a first ledge that has a backside therein and a second ledge that has a backside therein; a second slip being connected to said first slip, said second slip having an arcuate inner face and an outer face, wherein said inner face has a second longitudinally disposed slot that extends the length of said slip and wherein said second longitudinally disposed slot has a third ledge that has a backside therein and a fourth ledge that has a backside therein; a third slip having an arcuate inner face and outer face, wherein said inner face has a third longitudinally disposed slot that extends the length of said slip and wherein said third longitudinally disposed slot has a fifth ledge that has a backside therein and a sixth ledge that has a backside therein; a first insert having a shoulder at is configured to fit within said first ledge and abuts said backside of said first ledge; a second insert having a shoulder that is configured to fit within said second ledge and abuts said backside of said second ledge; a third insert having a shoulder that is configured to fit within said third ledge and abuts said backside of said third ledge; a fourth insert having a shoulder that is configured to fit within said fourth ledge and abuts said backside of said fourth ledge; a fifth insert having a shoulder that is configured to fit within said fifth ledge and abuts said backside of said fifth ledge; and a sixth insert having a shoulder that is configured to fit within said sixth ledge and abuts said backside of said sixth ledge;

placing a first tubular member within the rotary table on the drill rig floor;

inserting the slip device into the rotary table;

engaging the slip device about the first tubular member so that the first insert, the second insert, the third insert, fourth insert, fifth insert, and sixth insert engage the first tubular member and wherein the first tubular member is suspended from the rotary table thereby creating a load;

transferring the load of the first tubular member to the first insert, the second insert, the third insert, the fourth insert, the fifth insert, and the sixth insert;

transferring the load of the first insert, the second insert, the third insert the fourth insert, the fifth insert, and the sixth insert to the shoulder's of the first insert, second insert, third insert, the fourth insert, the fifth insert, and the sixth insert inserts;

transferring the load from the shoulder's of the first insert, the second insert, the third insert, the fourth insert, the fifth insert and the sixth insert to the ledges of the respective first, second and third slip so that the load of the first tubular member is distributed about the length of the first slip, the second slip and the third slip and wherein said first, said second, said third, said fourth, said fifth, and said sixth inserts are individually supported on said respective first, said second, said third, said fourth, said fifth, and said sixth ledges.

19. The method of claim 18 further comprising:

threadedly connecting a second tubular member to said first tubular member;

removing the slip device from the rotary table;

lowering the connected first tubular member and the second tubular member;

inserting the slip device into the rotary table;

engaging the slip device about the second tubular member;

transferring the load of the first and the second tubular member to the first, the second, the third insert, fourth insert, fifth insert, and sixth insert;

transferring the load of the first and the second tubular member from the shoulder's of the inserts to the ledges of the respective first, second and third slip so that the load of the first and the second tubular member is distributed about the length of the first slip, the second slip and the third slip.

* * * * *